US006401982B1

(12) United States Patent
Grittmann

(10) Patent No.: US 6,401,982 B1
(45) Date of Patent: Jun. 11, 2002

(54) COUNTERSINKABLE TAP WITH A TAMPER-EVIDENT DEVICE FOR LIQUID CONTAINERS

(76) Inventor: Guenter Grittmann, Ringstrasse 6, D-75031, Eppingen (DE)

( * ) Notice: Subject to any disclaimer, the term of this patent is extended or adjusted under 35 U.S.C. 154(b) by 0 days.

(21) Appl. No.: 09/847,285

(22) Filed: May 3, 2001

(30) Foreign Application Priority Data

May 3, 2000 (DE) ..... 100 21 541

(51) Int. Cl.[7] ..... B67B 5/00

(52) U.S. Cl. ..... 222/153.05; 222/153.06; 222/153.14; 222/511; 222/519; 251/351

(58) Field of Search ..... 222/153.06, 153.05, 222/153.14, 511, 519, 522, 523, 541.6, 541.9; 251/351

(56) References Cited

U.S. PATENT DOCUMENTS 3,237,818 A * 3/1966 Bijvoet et al. ..... 222/522
3,493,146 A * 2/1970 Conners et al. ..... 222/153
4,351,455 A * 9/1982 Bond ..... 222/153
4,478,242 A * 10/1984 Bond ..... 137/383
4,619,377 A * 10/1986 Roos ..... 222/83
5,579,953 A * 12/1996 Perkins ..... 222/1
5,961,001 A * 10/1999 Davis et al. ..... 222/153.06
6,158,622 A * 12/2000 Igarashi ..... 222/107

* cited by examiner

*Primary Examiner*—Henry C. Yuen
*Assistant Examiner*—Frederick Nicolas
(74) *Attorney, Agent, or Firm*—Foley & Lardner

(57) ABSTRACT

A countersinkable tap for liquid containers is provided. The tap includes a tamper-evident device. The tap includes an outer tube having an abutment which bears against the can wall and adjacent to which is a sealing ring which seals off the can orifice. The tap also includes an inner tube mounted rotatably and displaceably in the outer tube, with a grip and with orifices to allow beverage flow out of the can interior through the outer tube to the inner tube. The inner tube has a spigot which engages into a radially running slot of the outer tube. The outer tube includes a wedge punch and the grip possessing a tab which covers the wedge punch and onto which is integrally formed an inwardly directed thickened portion which, when the grip is rotated, slides on the wedge punch and opens the tab to indicate tampering.

9 Claims, 3 Drawing Sheets

COUNTERSINKABLE TAP WITH A TAMPER-EVIDENT DEVICE FOR LIQUID CONTAINERS

BACKGROUND OF THE INVENTION

The present invention relates to a countersinkable tap for liquid containers. In particular the invention relates to a tap having a tamper evident device. The tap is particularly suitable for use with beverage cans, such as, for example, party kegs of beer.

EP 0 912 407 B1 discloses a liquid container with such a countersinkable tap. The tap has an outer tube and an inner tube displaceable in the inter tube. The inner tube can be extended out of the outer tube and thereby brought from a closing position into an open position. In the open position coinciding bores allow liquid flow out of the container. Attached to the inner tube is a pivotable pull grip having an orifice. A lead seal, which is welded to a flange of the outer tube, is inserted through the orifice. The flange rests on the can wall.

When the grip is pivoted off of its seat in order to pull the inner tube into the open position, the lead seal breaks off.

This design presents at least two disadvantages. First, the lead seal has to be manufactured and fastened separately. Second, the glass to be filled is normally held under the tap when the liquid is being drawn off, therefore it is not possible to prevent the broken-off head of the lead seal from falling into the glass. This, of course, presents hygiene problems.

Another tamper-evident device has been developed (DE 19835569 A1) by the assignee of the present patent application. The device includes a pin which is integrally formed on the abutment of the outer tube. The pin is sheared off, when the grip is rotated, by a blade arranged on the grip. The sheared off pin falls down vertically from the can edge, and, although the risk of it falling into the drinking glass is, albeit greatly reduced, nevertheless the risk is not prevented completely.

Another disadvantage of this design is that, at relatively low temperatures, the plastic pin becomes so hard that it is difficult to shear off. However, this tamper-evident device does have the advantage of not requiring the separate fitting of the lead seal.

DE 3803153 A1 discloses a protective cap for kegs. The kegs have webs which break open at predetermined breaking points when the cap is removed. These webs remain on the cap, thus avoiding the situation where these caps penetrate into the keg closure. By contrast, with such a cap, it is not possible for a tap to be opened.

A similar "keg snap lid" with a lead seal function, which has "snapping-off barbs", is described in "Brauwelt" ["Brewing World"], no 43, 187, page 1958. This cannot be used, either, as a tap for beverage cans.

SUMMARY OF THE INVENTION

One object of the present invention is, therefore, to provide a tap with tamper-evident device which does not require the separate welding on of a lead seal. The tap can therefore be manufactured concomitantly in a simple way using injection molding. This design prevents detached parts from falling down, the tamper-evident device having a permanent and visible deformation after the tap has been opened for the first time. Another object of the invention is to provide a design that prevents the tap from jamming.

According to the present invention, a tap for a liquid container including a tamper-evident device is provided. The tap includes an outer tube and an inner tube positioned inside the outer tube. The inner tube is configured to rotate within the outer tube to open the tap and allow liquid in the container to flow through the tubes. The tap includes a grip connected to the inner tube and including a tab positioned to interact with a wedge located on the outer tube. The grip is configured so that when the inner tube is rotated to open the tap the tab contacts the wedge and is permanently deformed to indicate that the tap has been tampered with.

Preferably, the tab includes a thickened portion having a wedge shaped corresponding to the shape of the wedge located on the outer tube. The tab may include a notched portion positioned to allow the tab to bend at the notch. The tab may be connected to the grip by any of a number of suitable methods including welding or sealing. The tap may further include a slot located on the outer tube for receiving a spigot located on the inner tube. The slot may be curved and include radial and axial regions. The spigot may include a rounded portion for allowing movement of the spigot in the curved slot.

It is to be understood that both the foregoing general description and the following detailed description are exemplary and explanatory only, and are not restrictive of the invention as claimed.

BRIEF DESCRIPTION OF THE DRAWINGS

The present invention is explained in more detail with reference to the accompanying figures, in which.

DETAILED DESCRIPTION OF THE PREFERRED EMBODIMENTS

Figure 1:
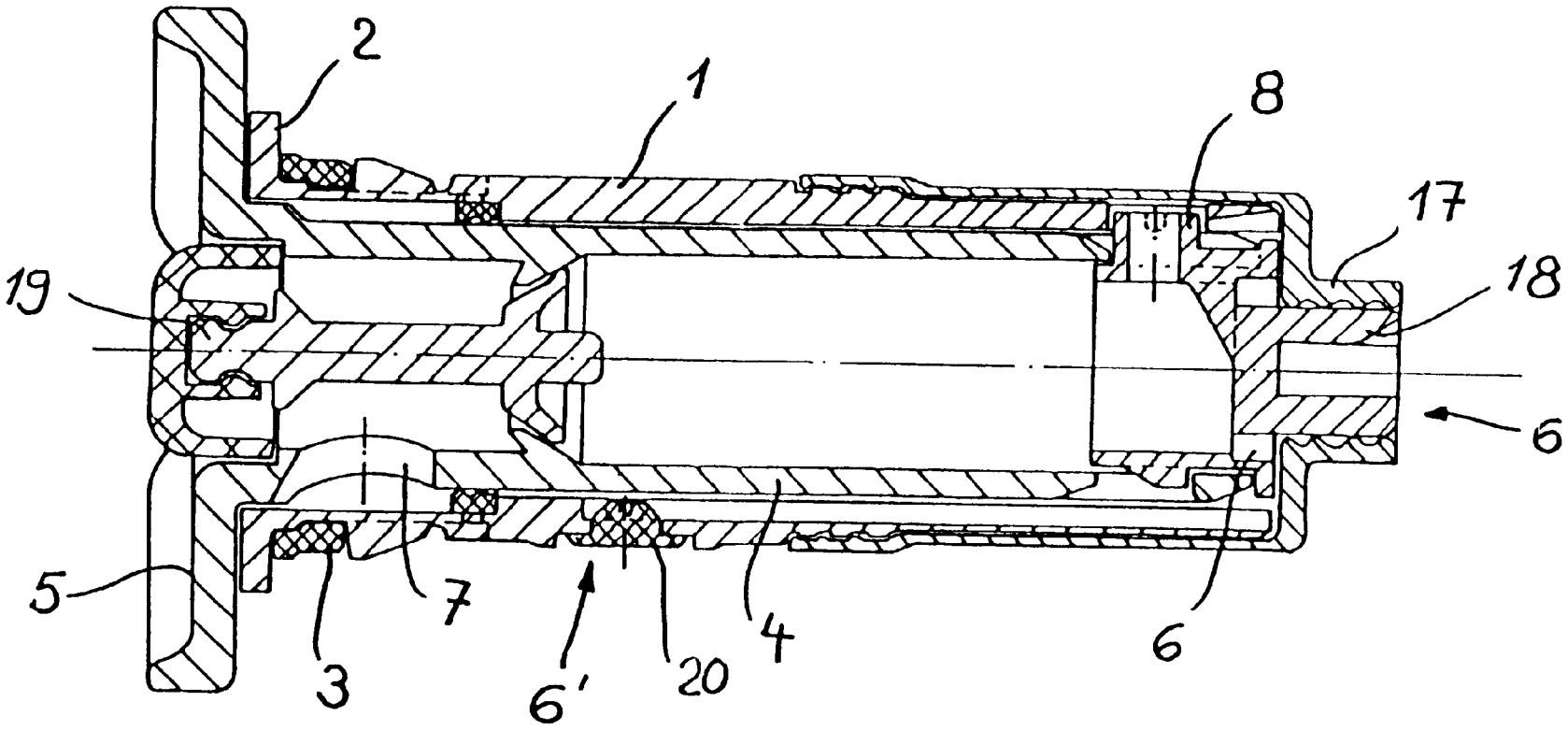
FIG. 1 is a sectional view through the tap.

According to the present invention, the tamper-evident device functions as follows. When the beverage can is delivered, the inner tube lies in the outer tube, the grip of the inner tube bearing on an abutment of the outer tube. A tab covers the wedge. The tab includes a thickened portion behind the wedge top edge and extending down approximately as far as the lowest point of the wedge top edge.

A spigot engages into the slot of the outer tube and can be guided only radially. As a result, the inner tube cannot be pulled out, but instead is secured. An opening of the tap is therefore initiated only by a rotational movement without any axial advance.

This rotational movement leads to the sliding open of the thickened portion of the tab, said thickened portion being rigidly connected to the spigot, with the result that the tap is opened. In this case, the distance that the grip moves during sliding-open is chosen so that the tab is overstretched and gapes open after renewed closing. Thus, there is a permanent indication of the first opening action. If a curved slot with an axial component is integrally formed on the radial slot and if the spigot is rotated beyond the first radial region of the curved slot, said spigot passes into a helical continuation. Thus, the inner tube undergoes an axial movement. The helical shape, in this case, preferably covers an angle of 90°, so that, when gripping handles are present, the handles move from a vertical position into a horizontal position, allowing the inner tube to then be pulled out completely.

The applicant's own DE 198 35 569 A1 (incorporated by reference herein) shows such a solution, in which the two gripping handles have located between them a button which opens a valve so as to cause the beverage to flow.

The thickened portion of the tab may be produced as a wedge, in order to ensure the maximum opening travel for the tab. Furthermore, the tab may include a transversely running notched portion which acts as a joint and undergoes a stress-whitening break as a result of opening, so that the tab gapes open in a permanently deformed manner.

The tab may also have glued over it a seal which tears when pressed up by the thickened portion or the wedge. Although the seal tears, the separated parts of the seal remain adhered to the tab and to the adjacent grip part. The tear is clearly visible and, by its break, indicates a first opening. Alternatively or additionally, the tab may also be, in particular, spot-welded to the grip part opposite the notched portion, in order to provide a defined resistance to the opening action.

The tap may further include a recess having an edge on the wedge punch opposite the wedge of the thickened portion of the tab. The edge of the recess forms an abutment for the tap in one direction of rotation, while in the other direction of rotation an abutment is ensured by the spigot contacting the end of its corresponding slot. As a result, the grip is fixed in its initial position in a defined manner.

In a preferred embodiment of the invention, the grip plate includes an oblique face approximately parallel to the wedge face of the wedge punch. The oblique face of the grip plate provides an appreciable advantage. For example, because of manufacturing tolerances or improper handling, the spigot of the inner tube may jam at the transition from the radial region to the axial region of the curved slot. Therefore, the grip may not rotate or can be rotated only with difficulty in order to extend the inner tube. This action of transferring the spigot into the curved slot from the radial region of the latter is made considerably easier by the provision of the oblique face which slides onto the wedge punch. As a result, the inner tube is thereby pulled out and is not only pressed by the spigot. Jamming is thereby eliminated. The spigot may also be provided with a rounded-out portion facing the outer edge of the curved slot.

FIG. 1 illustrates the tap comprising the outer tube 1 and the inner tube 4 displaceably positioned in the outer tube 1. The outer tube 1 possesses the abutment 2 which contacts the outside of the can wall (not shown) and, behind said abutment, the sealing ring 3 which seals off and at the same time secures the tap relative to the can orifice. The outer tube 1 also includes an extension 17 into the can interior which is closed by means of a plug 18. When the inner tube 4 is pulled out with the aid of the grip 5, the extension 17 is opened and liquid can flow via the orifice 6 into the interior of the inner tube 4, at the same time arriving at a valve 19. When the valve 19 is actuated, the liquid flows out via the outflow 7. A further orifice 6' is opened by the ejection of a plug 20.

Connected to the inner tube 4 is a spigot 8 which engages into a curved slot 9 of the outer tube 1.

Figure 2:
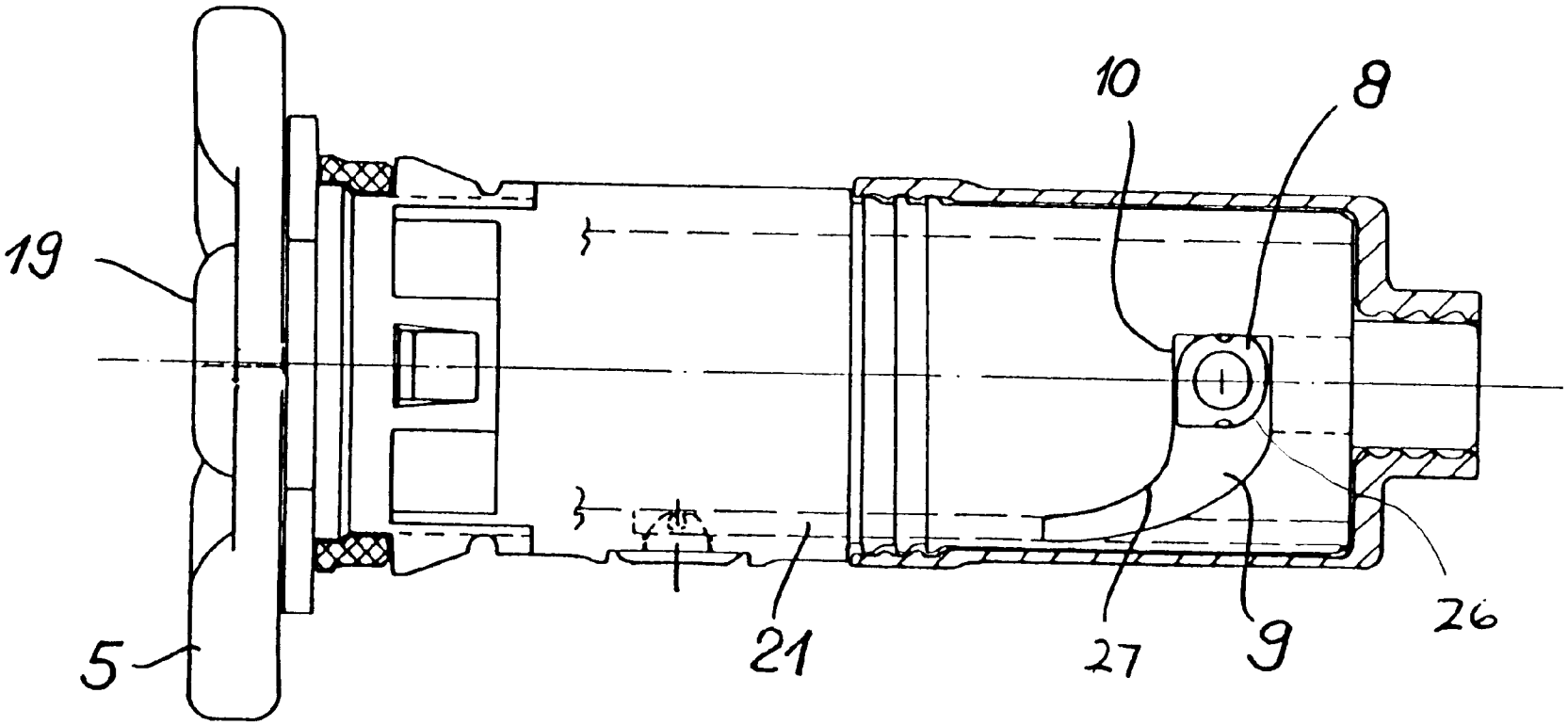
FIG. 2 is a top view showing the curved slot.

FIG. 2 shows this curved slot 9. It possesses an initial region 10 which first extends only radially. The spigot 8 comes into contact with end of the slot in the initial region 10 thereby preventing further inward rotation of the inner tube (FIG. 1). With the tap in the pushed-in state, the grip stands, in particular, vertically.

When the inner tube 4 is rotated (clockwise) via the grip 5, the spigot 8 passes into the helical region 27 and the inner tube 4 moves axially. After the tube has been rotated through 90°, the inner tube 4 can be pulled out of the outer tube 1 completely, because the slot 9 extends axially through its end portion 21.

The spigot 8 is provided with a rounded-out portion 26 which contacts the outside of the curved slot 9. The rounded-out portion slides in curved portion of the slot, allowing the spigot to be guided out of the radial region 10 to the axial region.

Figure 3:
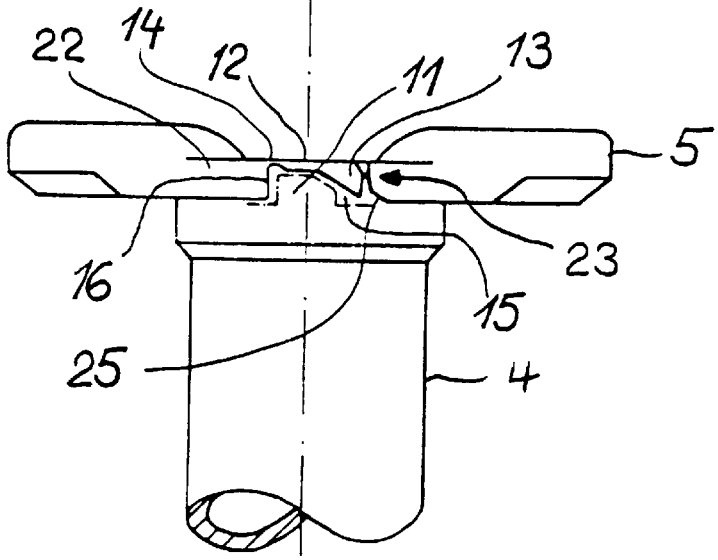
FIG. 3 is a top view of the tamper-evident device in its original sealed condition.

As illustrated in FIG. 3, which shows the inner tube 4, the tamper-evident device according to the invention cooperates with the above-described guidance of the spigot 8 in the curved slot 9. This tamper-evident device includes a wedge punch 11 located on the abutment 2 of the outer tube 1 (FIGS. 1 and 2). The wedge punch 11 is illustrated by dashes in FIGS. 3–5, because it is not fastened to the inner tube 4. The grip 5 is located on a plate 22 that includes a recess 15 for receiving the wedge punch 11 when the tap is in the closed state. In this case, the recess 15 bears with an edge 16 on the wedge punch 11, so that when the spigot 8 is secured at the end of the curved slot as shown in FIG. 2, the grip 5 is fixed in the position shown.

Figure 4:
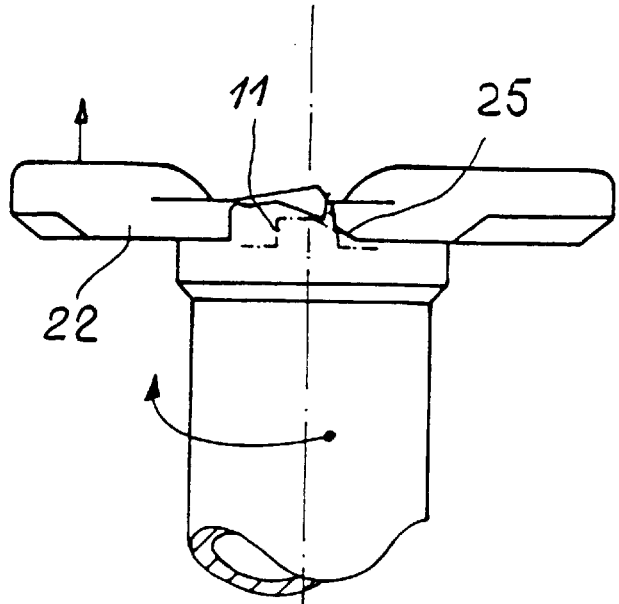
FIG. 4 is a view similar to FIG. 3 showing the seal after rotation of the inner tube.

The wedge punch 11 is covered by the tab 12. The tab includes a thickened portion 13 located adjacent wedge face of the wedge punch 11. When the grip 5 is rotated clockwise, as shown in FIG. 4, the thickened portion 13 is lifted by the wedge punch 11 and gapes open.

The tab 12 preferably includes the notched portion 14 which acts as a joint, but also signifies a weakening of material. The notched portion 14 may be subjected to plastic deformation (i.e., a stress-whitening break) by overstretching, due to dimensions of the wedge punch 11 and the thickened portion 13, so that, after the renewed countersinking of the inner tube, the tab can no longer return to its initial position. In this case, as shown in the figures, the thickened portion 13 is like a wedge, thereby permitting the maximum opening angle of the tab 12 to be obtained.

The tab 12 may be glued over the thickened portion 13, in order to form a seal with the adjacent region of the plate 22. The tab 12 may also have a spot weld 23 to the adjacent region of the plate 22. The spot weld 23 configured to break during opening and to provide an opposing force to the opening action of the tap defined by the size of the weld.

The plate 22 that carries the grip part 5 may also include an oblique face 25 located adjacent to the thickened portion 13 or the wedge face of the punch 11. Once the plate 22 is rotated (clockwise) with the aid of the grip 5, the oblique face slides on the wedge face of the wedge punch 11, as shown in FIG. 4, and lifts off the plate 22 from its initial position. This causes tensile force on the inner tube 4 (FIG. 2) and, after the tab has been opened, pulls the spigot 8 through the transition between the radial and the axial region of the curved slot 9 in order to prevent jamming.

Figure 5:
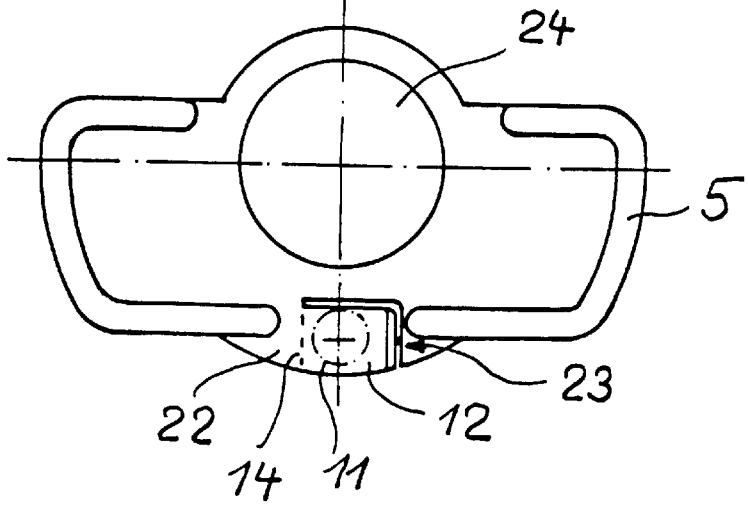
FIG. 5 is an end view of the tap.

The top view of FIG. 5 shows the grip 5 on its plate 22, the valve actuation 24 and the tab 12 with the notched portion 14 and with the spot weld 23 and also with the wedge punch 11 concealed underneath.

The priority document, German Patent Application No. 100 21 541.6, filed May 3, 2000, is incorporated by reference herein in its entirety.

What is claimed is:

1. A tap for a liquid container including a tamper-evident device comprising:

an outer tube;

an inner tube positioned inside the outer tube, wherein the inner tube rotates within the outer tube to open the tap and allow liquid in the container to flow through the tubes;

a grip connected to the inner tube and including a tab, and a wedge located on the outer tube; and wherein the tab and the wedge are arranged so that, when the inner tube is rotated to open the tap; the wedge contacts and permanently deforms the tab thereby indicating that the tap has been tampered with.

2. The tap of claim 1, wherein the tab includes a thickened portion having a wedge shape corresponding to the shape of the wedge located on the outer tube.

3. The tap of claim 1, wherein the tab includes a portion having a notch positioned to allow the tab to bend at the notch.

4. The tap of claim 1, wherein the tab is welded to the grip.

5. The tap of claim 1, wherein the tab is sealed to the grip.

6. The tap of claim 1, wherein the grip is configured so that when the tap is in a closed position the wedge rests against the grip.

7. The tap of claim 1, further comprising a slot located on the outer tube for receiving a spigot located on the inner tube.

8. The tap of claim 7, wherein the slot is curved and includes radial and axial regions.

9. The tap of claim 8, wherein the spigot includes a rounded portion for allowing movement of the spigot in the curved slot.

* * * * *